US008316584B2

(12) United States Patent
Wildenhain et al.

(10) Patent No.: US 8,316,584 B2
(45) Date of Patent: Nov. 27, 2012

(54) FIREPROOFING ELEMENT FOR A DOOR OR WINDOW LEAF

(75) Inventors: Klaus Wildenhain, Grevenbroich (DE); Daniel Suter, Jona (CH)

(73) Assignee: Vetrotech Saint-Gobain (International) AG, Bern (CH)

( * ) Notice: Subject to any disclaimer, the term of this patent is extended or adjusted under 35 U.S.C. 154(b) by 742 days.

(21) Appl. No.: 11/661,727

(22) PCT Filed: Aug. 30, 2005

(86) PCT No.: PCT/CH2005/000507

§ 371 (c)(1),
(2), (4) Date: Apr. 3, 2007

(87) PCT Pub. No.: WO2006/024187

PCT Pub. Date: Mar. 9, 2006

(65) Prior Publication Data

US 2008/0127596 A1 Jun. 5, 2008

(30) Foreign Application Priority Data

Sep. 3, 2004 (CH) ..... 1457/04

(51) Int. Cl.
*E06B 1/04* (2006.01)

(52) U.S. Cl. ..... 49/505; 49/381; 52/211; 52/232

(58) Field of Classification Search ..... 49/504, 49/505, 501, 381; 52/211, 232
See application file for complete search history.

(56) References Cited

U.S. PATENT DOCUMENTS

| | | | | | |
|---|---|---|---|---|---|
| 2,554,399 | A * | 5/1951 | Bremer | 109/77 |
| 2,739,674 | A * | 3/1956 | Casebolt | 49/505 |
| 3,571,996 | A * | 3/1971 | Braswell | 52/217 |
| 3,585,770 | A * | 6/1971 | Maizler | 52/217 |
| 3,981,102 | A * | 9/1976 | Harwood et al. | 49/501 |
| 4,660,338 | A * | 4/1987 | Wagner | 52/232 |
| 5,244,709 | A * | 9/1993 | Vanderstukken | 428/99 |
| 5,656,558 | A * | 8/1997 | Brix et al. | 501/70 |
| 5,990,023 | A * | 11/1999 | Siedel et al. | 501/70 |
| 6,082,050 | A * | 7/2000 | Schilling | 49/505 |
| 6,327,826 | B1 * | 12/2001 | Mann | 52/204.1 |
| 6,434,899 | B1 * | 8/2002 | Fortin et al. | 52/232 |

(Continued)

FOREIGN PATENT DOCUMENTS

FR 002701286 * 8/1994

*Primary Examiner* — Katherine w Mitchell
*Assistant Examiner* — Catherine A Kelly
(74) *Attorney, Agent, or Firm* — Notaro, Michalos & Zaccaria P.C.

(57) ABSTRACT

The invention relates to a fireproofing element comprising a fireproof glazed element (1) which forms a window or door leaf (8). A bulkhead frame (3) is arranged around the door leaf (8), inserted in the building (2). A deformable component (28) is built in between the bulkhead frame (3) and the building (2). At least one telescopic element (15) is arranged between a lateral edge (10) of the door leaf (8) and the bulkhead frame (3). Said telescopic element (15) is displaceable relative to the bulkhead frame (3) in the direction of the arrows (20). The telescopic element (15) can compensate for changes in the joint (50) between the door leaf (8) and the bulkhead frame (3) and/or also seal said joint (50). Changes in length as a result of heating of the components during a fire can thus be accommodated and the door leaf (8) and fireproofing glazed element (1) hence not destroyed.

14 Claims, 4 Drawing Sheets

Figure 1:
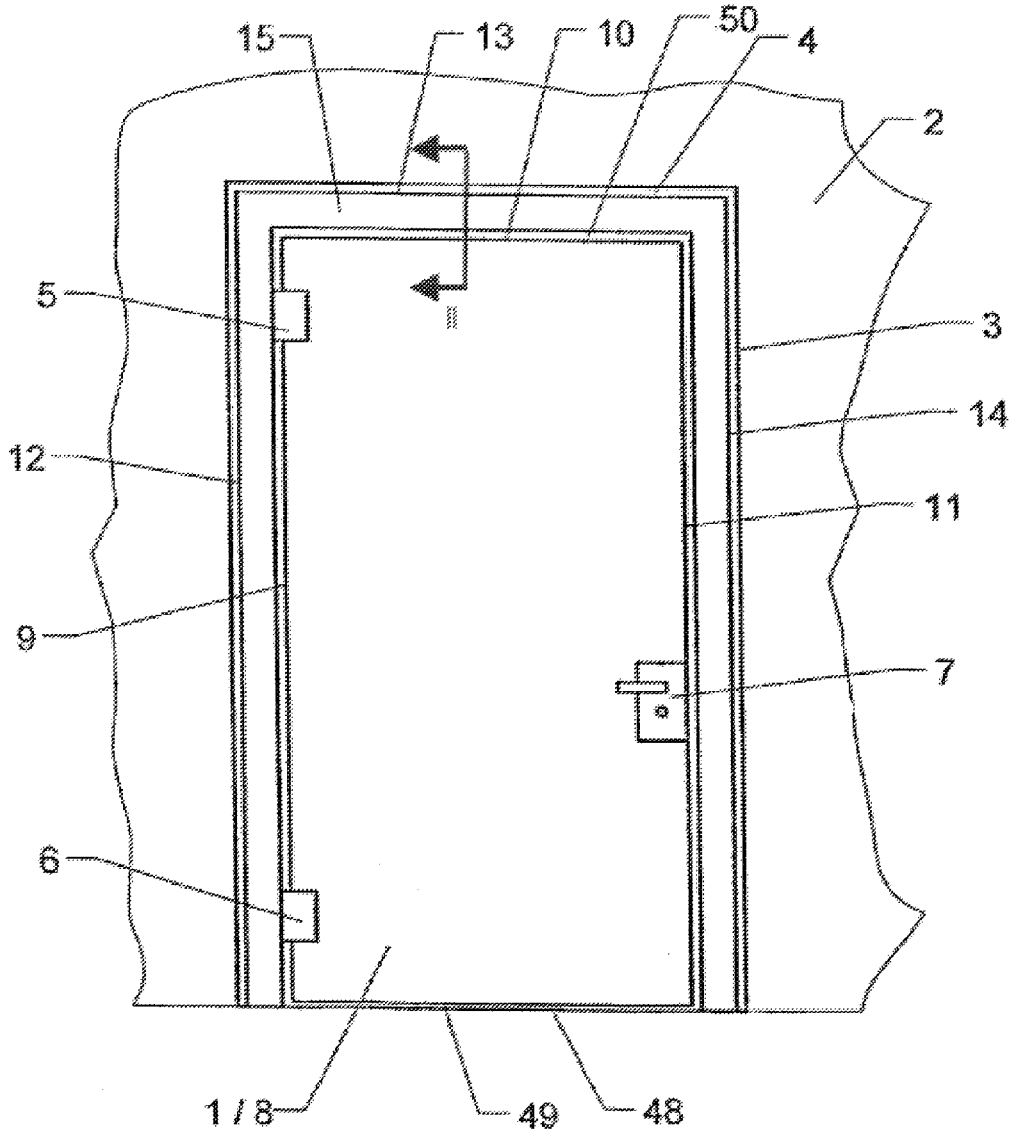

U.S. PATENT DOCUMENTS 6,574,929 B2 * 6/2003 Wildenhain et al. ..... 52/232
6,668,499 B2 * 12/2003 Degelsegger ..... 52/204.62
6,905,991 B1 * 6/2005 El Khiati et al. ..... 501/70
6,981,351 B2 * 1/2006 Degelsegger ..... 52/784.11
2001/0018817 A1 * 9/2001 Degelsegger ..... 52/784.11
2001/0023557 A1 * 9/2001 Graham ..... 49/504

* cited by examiner

FIREPROOFING ELEMENT FOR A DOOR OR WINDOW LEAF

The invention relates to a fire safety-structural element for doors or windows with at least one fire safety glass unit with fittings for fastening and/or closure elements as a door or window leaf, the fire safety glass unit being insertable into an opening with an architrave frame of a building closing off such.

In the construction industry glass units are very frequently employed, in particular for door or window leaves, and also for partitioning walls. These glass units are most often installed into a frame, on which are disposed corresponding fittings for fastening and/or closure elements. This glass and frame unit is subsequently connected by means of the fittings with the building, or is held thereon. A corresponding arrangement for a door is disclosed for example in U.S. Pat. No. 4,671,016. According to this arrangement, a pane of safety glass is clamped at the lower and upper edge in a frame element. The frame elements and the glass pane form a planar element in the shape of a door leaf, all parts being firmly connected with one another. The depicted door leaf is set into an opening in a building in a manner not shown and is encompassed by a known door frame with door architraves. This architrave frame, in turn, is fastened and supported on the building.

Such arrangement is incapable of developing a sufficient fire safety effects in the event of a fire. The disadvantage of this arrangement includes that the glass pane with the frame parts fixedly connected therewith expands upon heating and specifically in height as well as also in width. The joint gaps normally provided between door leaf and outer frame in such leaf arrangements, in particular doors, are incapable of absorbing these changes of length due to thermal expansion. In the case of glass doors, which are approved as fire safety doors, the joint gap is not permitted to be larger than a specified maximum dimension. This maximum joint gap is smaller than the change in length of the door leaf due to heating. In particular, in the direction of height of a door for example, the door leaf becomes seized in the architrave frame, or in the building, and the glass pane is destroyed through the generated compressive stress. Thereby any protective action against a fire event becomes inapplicable.

According to AT 004250 U1 it is also known to dispose on the architrave frame a sealing profile comprised of a material which foams when exposed to heat. In the event of a fire and under the impact of heat this sealing profile foams and closes off the joint gap between the architrave frame or door frame and the door leaf. This arrangement would in principle make possible providing a larger joint gap. However, in the case of fire safety doors implemented according to fire safety regulations, this is not permissible. In a door arrangement in which the door leaf is comprised of a simple glass unit without frame, this known arrangement is inoperative. When using a glass unit without intermediate foaming layer, the glass becomes also deformed in the plane of the glass pane in the event of fire. The side edges of the glass unit bend under the impact of heat and subsequently are no longer in the region of the foaming sealing profiles. Their sealing effect is therewith no longer ensured. Moreover, changes of length of the door leaf, due to thermal insulation, also lead to seizing of the glass unit and to the destruction of the same.

The present invention therefore addresses the problem of accomplishing in the event of fire a fire-resistant element with a fire safety glass unit for doors or for windows, in which the glass unit with conventional joint gaps is to be insertable into an architrave frame in an opening of a building. Changes of length and deformation of the glass unit and its frame parts due to heating can occur without the glass unit being destroyed or the fire safety action being reduced and the glass unit can be developed without a frame.

According to the invention this problem is solved. Advantageous further developments of the invention are evident in the claims.

Between at least one side edge of a glass unit and a fixed element of an architrave frame adjacent to this side edge, the invented fire safety-structural element comprises an additional element in the form of a telescoping element. This telescoping element comprises a first, stationary part, and a second, displaceable part, in which in the direction of the plane of the glass unit between the two parts of the telescoping element is formed a free interspace. In the event of fire, the two parts of the telescoping element are displaceable relative to one another in the direction of the plane of the glass unit. This disposition according to the invention of a telescoping element with two parts which are displaceable relative to one another advantageously permits changes of length and deformations of the elements, in particular of the glass unit and the architrave frame. The free interspace between the two parts of the telescoping element can be enlarged or reduced, whereby in the plane of the glass unit increases of the dimensions of the parts as well as also decreases of the dimensions can be compensated. Therewith it becomes possible to compensate via the telescoping element(s) various dimensional changes, which in the event of fire occur as a consequence of the different materials, however also as a consequence of the different expansion behaviors, in the course of time of a fire. This ensures that in the event of fire the joint gap between the glass unit and the adjacent architrave frame is closed off without the glass unit needing to be clamped in and being exposed to impermissible loading. One advantageous development of the invention provides that the fire safety glass unit is frameless and that the fire safety glass unit is comprised of a simple prestressed glass pane. However, laminated glass units with several glass panes can also be utilized. In the case of the combination of a frameless fire safety glass unit of a simple prestressed glass pane as the door leaf with the telescoping elements between door leaf and architrave frame, a fire resistant structural element can be built, which corresponds at least to the fire safety class E30 according to the European Standards EN 13501. A glass pane is advantageously utilized which has a thermal stress factor $\phi$ between 0.5 and 0.85 $N/(mm^2 \times K)$. The thermal stress factor is calculated from the parameters thermal expansion coefficient $\alpha$, modulus of elasticity E and Poisson constant $\mu$ according to the formula $\phi=\alpha \cdot E/(1-\mu)$. Such glasses are disclosed in DE 197 10 289 C1.

A useful implementation of the subject matter of the invention provides disposing an elastic part between the two parts of the telescoping element. This elastic part can be a formed body of an elastic material or an elastic element, for example a compression spring. The elastic part can absorb and compensate positive as well as also negative changes of length. An especially useful solution results if the elastic part is a formed body containing a material foaming under heat impact. In this case the elastic part can compensate changes of length occurring in the event of fire, which are greater than the elastic change of shape of the part alone. Such formed bodies are generally known in fire safety technology and are commercially available for example under the designation pad tape.

The invention further proposes that the telescoping element transversely to the plane of the glass unit has a width which is at least twice the thickness of the glass unit. This implementation offers the advantage that the edge regions of the glass unit can also be deformed relative to the plane and yet the joint gap region is sealed as desired without the glass unit needing to be clamped in and being destroyed. This is advantageous in particular in view of the use of a frameless, simple and prestressed glass pane as a door leaf.

A further development of the invention provides that in the outer region of the interspace one elastic part in the form of a tape, comprised of a material foaming under heat impact, is placed between the two parts of the telescoping element, these two tapes being disposed at a free spacing with respect to one another transversely to the plane of the glass unit. This disposition yields the advantage that, in the event of an abutment of one side edge of the glass unit on the second part of the telescoping element, a clearance is formed between the two tapes which can be utilized as additional buffer space. The two tapes are located outside of the plane of the glass unit.

The invention further proposes that the first part of the telescoping element is formed by a portion of the architrave frame with rectangular cross section and the second part of the telescoping element has a U-shaped cross section, the bottom face of the U-part being directed against an edge of the glass unit and the two shank faces of the U-part being guided on the first part of the telescoping element. The invention proposes moreover that between the first part of the telescoping element and the architrave frame a deformable part is emplaced. This deformable part is advantageously formed by a profile tape of mineral wool. Therewith the architrave frame, which normally is formed of metal, can also compensate form and length changes via this deformable part even under heating in the event of fire. The architrave frame can also be formed of another suitable material, for example wood. The rectangular cross section of the first part of the telescoping element ensures high stability of the architrave frame and forms simultaneously a suitable guidance for the displaceable second part of the telescoping element with U-shaped cross section. However, for the first part another cross section, for example a U-shaped cross section, can also be utilized. The bottom face of the U-shaped second part is stayed on the alternate part in the outer regions via the elastic elements. The surface region of the bottom face between the elastic elements is formed such that it is resilient and this resilient region is located opposite a side edge of the glass unit. Even in the presence of strong buckling of a side edge of the glass unit as a consequence of the heating, such side edge is still within the region of the resilient bottom face and it can be deformed in the event of a contact due to changes in length. Concurrently with the resilient deformations of the bottom face of the second part, in such event the two elastic elements at the outer regions of the bottom face are also compressed. If these two elastic elements contain a material which foams under heat impact, these two elements expand in the event of fire and bend the bottom face of the second part of the telescoping element additionally over the side edge of the glass unit. Thereby optimal closing off of the joint gap between glass unit and architrave frame is ensured and simultaneously too large a compressive stress is prevented from building up in the glass unit through the changes in length.

A further development of the invention provides that at least at the upper side edge of the glass unit a closure rail is disposed which encompasses the telescoping element. In an advantageous implementation the first part of the telescoping element is formed by the edge region of the glass unit or a rail firmly connected with the glass unit. The second part of the telescoping element is here comprised of a rail with U-shaped cross section, the bottom face of the U-part being directed toward the architrave frame and the two shank faces of the U-part being guided on side faces of the first part. This embodiment of the invention permits the application of the invented solution in elements, in which the architrave frame cannot be equipped with a telescoping element. However, it is also possible to combine the two solutions with one another, whereby in some cases optimization of the fire safety can be attained. This disposition according to the invention permits a length compensation at the joint gap in the bottom region or the side edge of the glass unit which has fastening elements. This can be done in particular if in the interspace between the two parts of the telescoping element an elastic part with material foaming under heat impact is installed. During normal use of the invented fire-resistant elements, for example of a door, the elastic part is encapsulated in the telescoping element and thereby protected against damage and environmental effects. The operational function of the telescoping element is consequently ensured over long periods of time and the effectiveness in the event of fire is retained.

The term building, as used in this text, includes walls comprised of known building materials such as building blocks and wood, as well as also walls, in particular partitioning walls, of glass.

Figure 2:
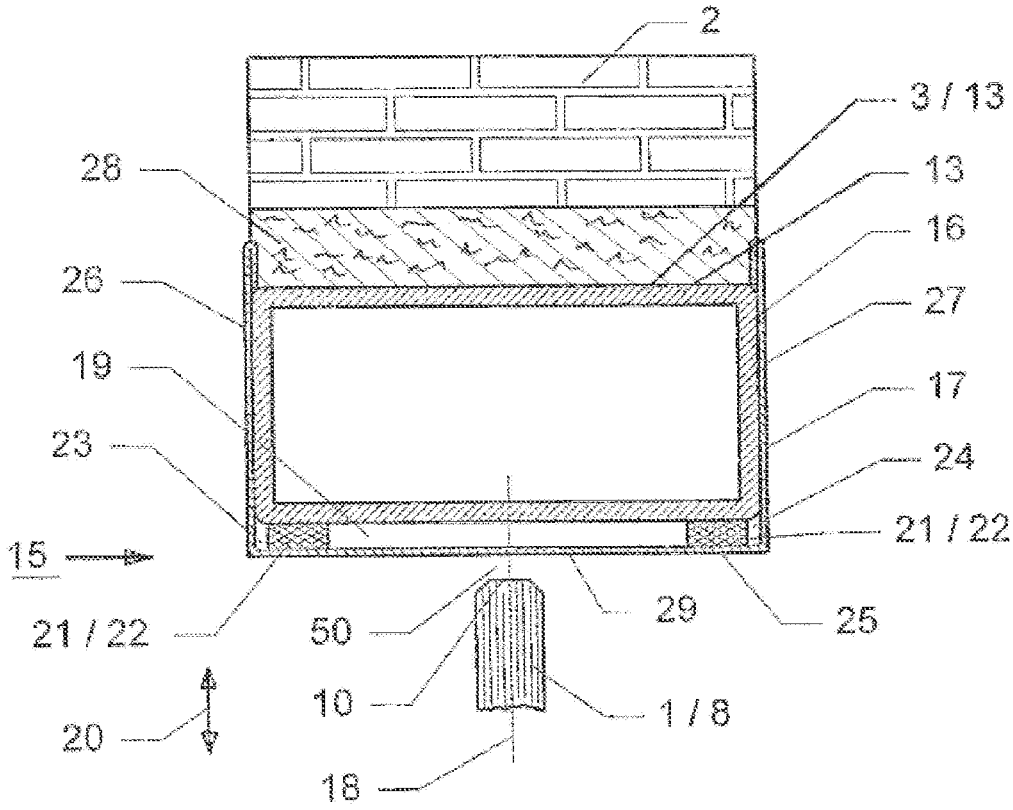
Figure 3:
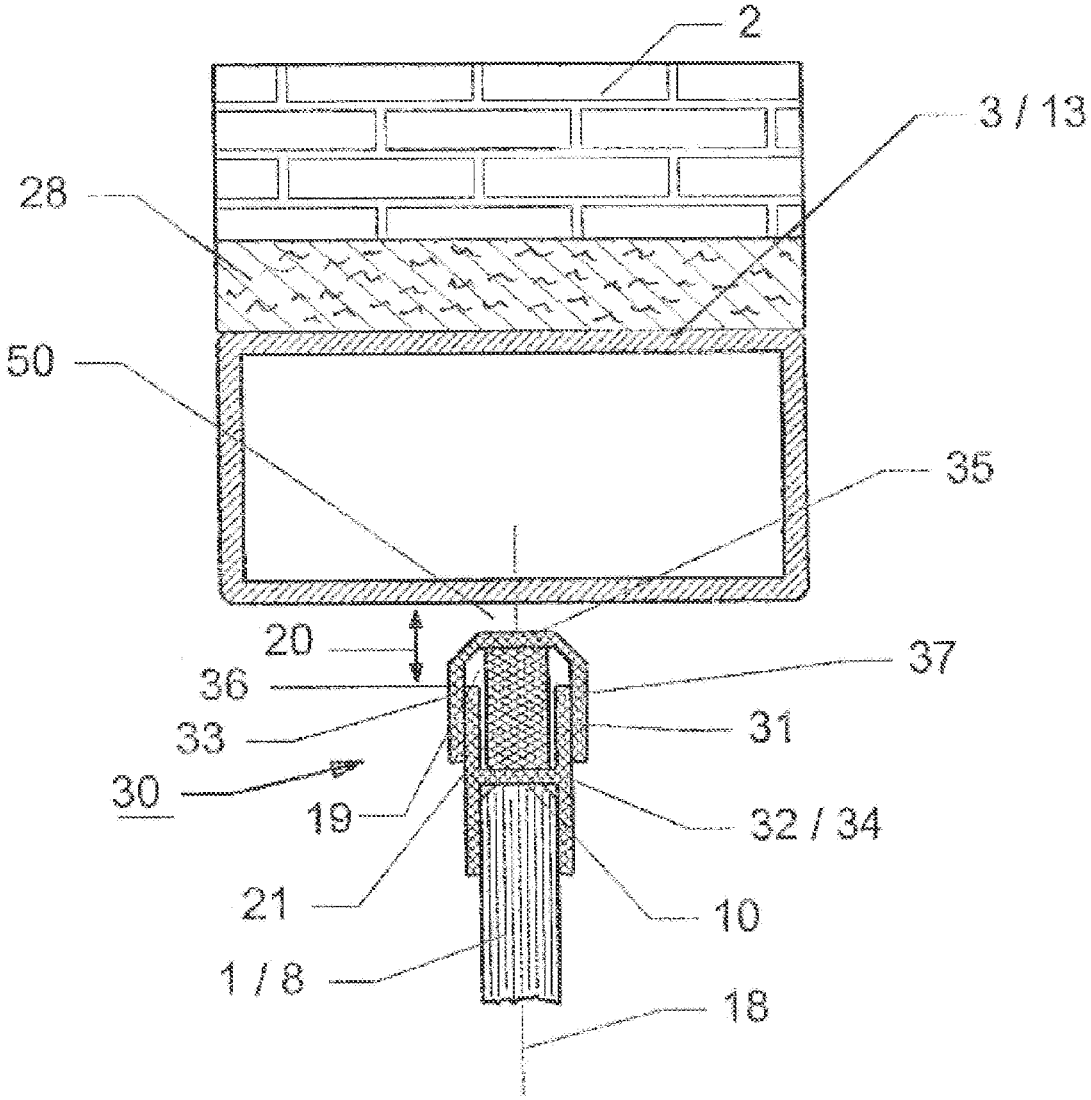
Figure 4:
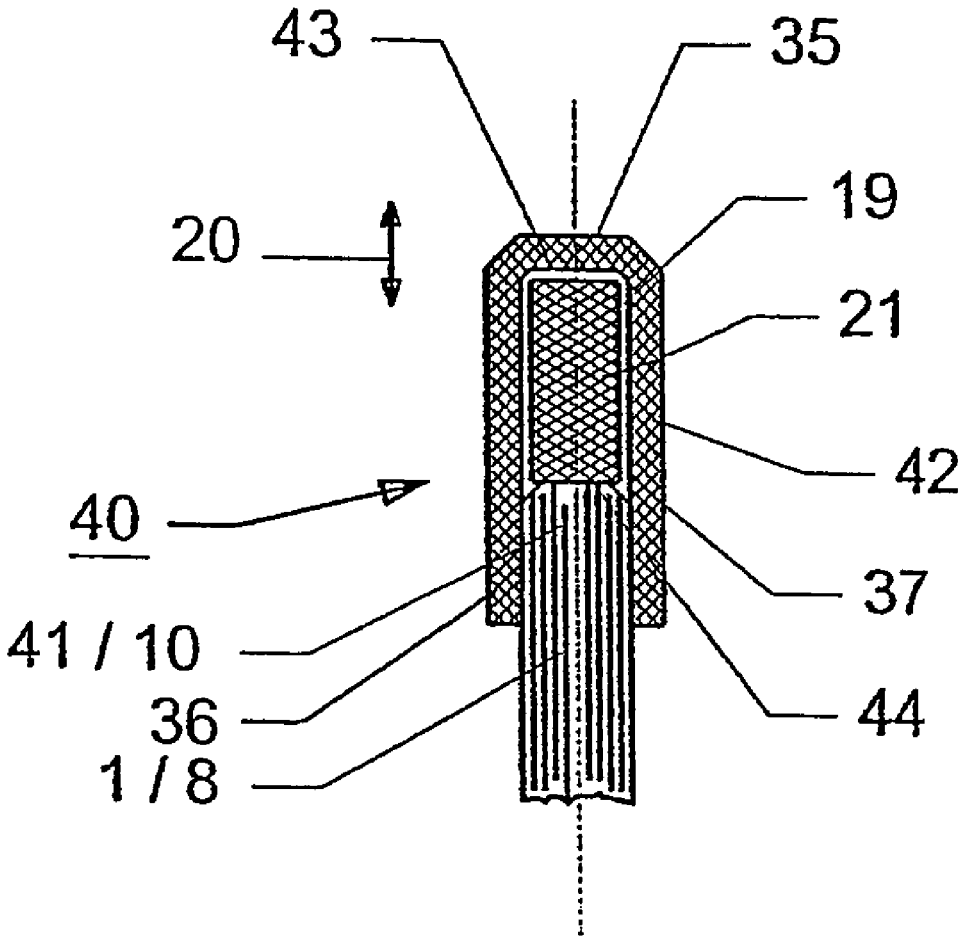

In the following the invention will be explained in further detail in conjunction with embodiment examples with reference to the enclosed drawing. Therein depict:

FIG. 1 an element according to the invention in the form of a door,

FIG. 2 a cross section through the upper architrave frame according to FIG. 1, FIG. 3 a cross section through the upper architrave frame of a structural element with a rail on the door leaf, and FIG. 4 a cross section through a second embodiment of a rail on the door leaf.

FIG. 1 is a segment of a building 2 and specifically a partitioning wall with an opening 4 in the form of a door penetration. Into this opening 4 is set an architrave frame 3 which encompasses a fire safety glass unit 1 in the form of a door leaf 8. This glass unit 1 is comprised of simple, prestressed glass pane which is frameless. The glass unit 1 in the depicted example is comprised of a prestressed alkali silicate glass. However, the glass unit 1 can also be comprised of several laminated glass panes. The glass unit 1 is provided with fastening fittings 5, 6 known per se, as well as a closure element 7, which cooperate with the architrave frame 3. The two fastening fittings 5, 6 position the door leaf 8 within the architrave frame 3. The door leaf 8, i.e. the fire safety glass unit 1, is so dimensioned that between parts 12, 13 and 14 of the architrave frame 3 as well as of the bottom face 49 of the building 2, on the one hand, and the side edges 9, 10, 11 as well as of the bottom edge 49 of the glass unit 1, on the other hand, a joint gap 50 of minimum size is comprised. This joint gap 50 is so dimensioned that the door leaf 8 can be swivelled without hindrance, and dimensional differences resulting from the fabrication and the mounting can also be absorbed.

FIG. 2 depicts a cross section through the door lintel at line 11 in FIG. 1, or through the upper portion 13 of the architrave frame 3, and the upper side edge 10 of the glass unit 1 according to FIG. 1. Of the glass unit 1, or the door leaf 8, only the upper region with the upper side edge 10 is shown. It is evident that the glass unit 1 does not have a frame. On the building 2 the architrave frame 3 is disposed, the upper portion 13 of the architrave frame 3 being visible in FIG. 2. This portion 13, or the architrave frame 3, is connected with the building 2 through a deformable part 28. The connection takes place via, not shown, fastening means known per se. The architrave frame 3 comprises a telescoping element 15 installed as additional element between the upper side edge 10 of the glass unit 1 and the building 2. The telescoping element 15 comprises a first part 16, this first part 16 being formed by the upper portion 13 of the architrave frame 3. This upper portion 13 of the architrave frame 3 has a rectangular cross section. The telescoping element 15 also comprises a second part 17 with a U-shaped cross section. This second part 17 includes a bottom face 25 and two shank faces 26, 27. The second part 17 of the telescoping element 15 is placed onto the first part 16 and the two parts 16, 17 are displaceable relative to one another in the direction of arrow 20. Between the bottom face 25 of the second part 17 and the first part 16 a free interspace 19 is formed permitting relative movements of the two parts 16, 17 with respect to one another. Between the bottom face 25 of the second part 17 of the telescoping element 15 and the upper side edge 10 of glass unit 1 the joint gap 50 is formed. In the depicted example the width of this joint gap 50 is approximately three millimeters. This corresponds to the regulation for the fire safety test of a fire safety-structural element of class E30 according to the European Standard EN 13501 and/or the test for movable parts according to EN 1634. In the interspace 19 between the first part 16 and the second part 17 of the telescoping element 15 at least one elastic part 21 is installed. In the depicted example the elastic part 21 is comprised of two formed parts in the form of tapes 22. These two tapes 22 are installed in the outer regions 23 and 24 of interspace 19 and have a free spacing from one another. The tapes 22 are comprised of an elastic material at least partially including a material foaming under heat impact. Such tapes 22 or similarly shaped formed parts are generally known in fire safety engineering and are employed for example under the designation pad tapes. The tapes 22, or the elastic parts 21, permit the displacement of the second part 17 in the direction of arrows 20 parallel to the plane 18 of the glass unit 1. The tapes 22 can therein be compressed if the glass unit 1 expands due to heating and presses against the bottom face 25 of the second part 17. However, it is also possible that the tapes 22 expand as a consequence of the heat impact and that thereby the bottom face 25 of the second part 17 of the telescoping element 15 is pushed against the upper side edge 10 of the glass unit 1. As a consequence thereof, the joint gap 50 is closed off. If the tapes 22 expand more strongly, the bottom face 25 is arched over the side edge 10. This is possible since the surface region 29 of bottom face 25 is formed such that it is resilient and exerts only a low pressure onto the side edge 10 of glass unit 1. This ensures that the glass unit 1 is not under compressive stress and destroyed thereby. This function is optimized thereby that the telescoping element 15 transversely to the plane 18 of glass unit 1 has a width which is at least twice the thickness of glass unit 1. In the depicted example the width of the telescoping element 15 is approximately eight to ten times greater than the thickness of glass unit 1. This implementation and disposition of an invented telescoping element 15 permits, on the one hand, movements in which the glass unit 1 and the architrave frame 3 move toward one another and abut one another. However, on the other hand, and simultaneously, movements are also possible in which the glass unit 1 and the architrave frame 3 move away from one another and thereby would enlarge the joint gap 50. Since these movements, or deformations, of the architrave frame 3 or the glass unit 1 are a consequence of the heating of these elements by the fire, the heat acts simultaneously also on the elastic parts 21 or tapes 22. The material, foaming or expanding under heat impact, of tapes 22 causes the opposite movement, or displacement, of the second part 17 of telescoping element 15 in the direction of the side edge 10 whereby the enlarging joint gap 50 is closed again. The telescoping element 15 according to the invention consequently is capable of fulfilling several functions and therewith permits the depicted combination of a frameless glass unit 1 as a door leaf 8 with an architrave frame 3 of metal. This combination could not be satisfactorily solved with the previously known solutions since the different coefficients of thermal expansion and their time functions have led to overloadings and therewith untimely destruction of the parts, in particular of the glass unit 1.

FIG. 3 depicts another embodiment according to the invention at a cross-section through the architrave frame similar to that of FIG. 2, in which the telescoping element 31 is not disposed on the architrave frame 3 but rather directly on the glass unit 1. This disposition is useful especially if at the upper side edge 10 and/or at the bottom edge 49 of glass unit 1 a closure rail 30 is disposed. In the depicted example the closure rail 30 is comprised of a profiled rail 34 connected firmly with the glass unit 1 and forming simultaneously the first part 32 of telescoping element 31. The second part 33 of the telescoping element 31 is also comprised of a rail with a U-shaped cross section. The bottom face 35 of this second part 33 is directed toward the architrave frame 3 and with joint gap 50 spaced apart from it. The two shank faces 36, 37 of the second part 33 are in contact on side faces of the first part 32 and are guided on it. A relative movement between the two parts 32 or 33, respectively, of telescoping element 31 in the direction of arrows 20 is thereby possible. Between the two parts 32 and 33 of telescoping element 31, again, a free interspace 19 is formed. In this interspace 19 is disposed an elastic part 21 which permits the movements of the second part 33 of telescoping element 31 in the direction of arrows 20. This elastic part 21 is comprised of the same materials as described with reference to FIG. 2. The architrave frame 3 is again connected with the building 2 via a deformable part 28, in the depicted example a tape of mineral wool. This deformable part 28 serves, on the one hand, for compensating dimensional discrepancies and irregularities between opening 4 in building 2 and architrave frame 3 and, on the other hand, for partially absorbing deformations of architrave frame 3 due to heating.

FIG. 4 depicts a cross-section though the upper edge of the door similar to that of FIG. 3 of a simplified solution of the disposition according to FIG. 3. The region of the side edge 10 of glass unit 1 forms the first part 41 of telescoping element 40. The second part 42 of telescoping element 40 is again formed by a U-shaped rail whose bottom face 35 is directed toward architrave frame 3. The shank faces 36 and 37 of the second part 42 are directly in contact on the side faces of glass unit 1 and are guided thereon. In the free interspace 19 between the first and the second part 41, 42 of telescoping element 40 an elastic part is also disposed and this part is adhered with the contact faces 43 and 44 to the side edge 10 or the second part 42 of telescoping element 40, respectively.

Depending on the construction and the fire safety requirements, the invented telescoping element 15 and 31 and 40, respectively, according to FIGS. 1 to 4 may be disposed only on the upper portion 13 of architrave frame 3 or only on the upper side edge 10 of glass unit 1. If necessary, however, they can also be disposed additionally on the left portion 12 and/or the right portion 14 of architrave frame 3, or on the left side edge 9 and/or on the right side edge 11 of the glass unit 1. It is, moreover, also feasible to attach one telescoping element 31 or 40 on a side edge 9, 10 and/or 11 of the glass unit 1 and simultaneously also one telescoping element 15 on one or several of portions 12, 13, 14 of architrave frame 3. This may be useful with increased requirements made of the fire resistance of the fire safety-structural elements according to the invention.

The invention claimed is:

1. A fire safety-structural element for doors or windows, comprising:

at least one fire safety glass unit defining a plane and serving as a door or window leaf, the fire safety glass unit being insertable into an opening with a frame in a building to close off the opening;

a telescoping element between at least one side edge of the fire safety glass unit and a fixed element of the frame and adjacent the side edge, the telescoping element comprising a first stationary part, and a resilient second, displaceable part;

a free interspace being formed between the two parts of the telescoping element and in each of two outer regions of the free interspace, one elastic element, each elastic element being a tape of a material foaming under heat impact, the two tapes being disposed transversely to the plane of the fire safety glass unit with a free spacing with respect to one another; and a joint gap being formed between the resilient second part of the telescoping element and the fire safety glass unit, and, in the event of fire, the resilient second part is displaceable relative to the first part so that the joint gap is closed off by direct contact between the resilient second part of the telescoping element and the fire safety glass unit.

2. The fire safety-structural element as claimed in claim 1, wherein the resilient second, displaceable part of the telescoping element has a resilient face which is deformed by the fire safety glass in the event of fire.

3. The fire safety-structural element as claimed in claim 1, further comprising an elastic member which is separated from direct contact with the fire safety glass by the resilient second, displaceable part of the telescoping element, wherein the elastic member expands and pushes against the resilient second, displaceable part in the event of fire.

4. The fire safety-structural element as claimed in claim 1, wherein the fire safety glass unit is frameless.

5. The fire safety-structural element as claimed in claim 1, wherein the fire safety glass unit is comprised of at least one prestressed glass pane.

6. The fire safety-structural element as claimed in claim 1, comprising an elastic element in the interspace between the two parts of the telescoping element.

7. The fire safety-structural element as claimed in claim 6, wherein the elastic element between the two parts of the telescoping element is a body comprising a material foaming under heat impact.

8. The fire safety-structural element as claimed in claim 1, wherein the telescoping element has a width transversely to the plane of the fire safety glass unit which is at least twice the thickness of the glass unit.

9. The fire safety-structural element as claimed in claim 1, wherein the first part of the telescoping element is formed by a portion of the frame with rectangular cross section and the resilient second part of the telescoping element has a U-shaped cross section, the bottom face of the resilient second part of the telescoping element being directed toward an edge of the fire safety glass unit and two shank faces of the resilient second part being guided on the first part of the telescoping element.

10. The fire safety-structural element as claimed in claim 9, comprising two elastic elements in the interspace between the two parts of the telescoping element, wherein the bottom face of the resilient second part of the telescoping element is stayed in outer regions via the elastic elements on the first part, and surface region between the elastic elements is resilient and located opposite a side edge of the glass unit.

11. The fire safety-structural element as claimed in claim 1, comprising a deformable part disposed between the first stationary part of the telescoping element and the building.

12. The fire safety-structural element as claimed in claim 11, wherein the deformable part is a profile tape of mineral wool.

13. The fire safety-structural element as claimed in claim 1, wherein the fire safety glass unit is comprised of at least one thermally prestressed glass unit, a glass being utilized having a thermal stress factor $\phi$ between 0.5 and 0.85 $N/(mm^2 \times K)$.

14. The fire safety-structural element as claimed in claim 1, wherein the first part of the telescoping element and the resilient second part of the telescoping element are fire-resistant.

* * * * *